United States Patent [19]

Villanyi et al.

[11] Patent Number: 4,947,814

[45] Date of Patent: Aug. 14, 1990

[54] RETRACTABLE THROTTLE STOP

[75] Inventors: Tibor J. Villanyi, Columbus; John D. Crofts, Edinburgh, both of Ind.

[73] Assignee: Cummins Engine Company, Inc., Columbus, Ind.

[21] Appl. No.: 309,874

[22] Filed: Feb. 14, 1989

[51] Int. Cl.[5] ..... F02D 9/02

[52] U.S. Cl. ..... 123/396; 123/365; 123/377

[58] Field of Search ..... 123/359, 365, 373, 376, 123/377, 198 DB, 198 D, 400, 396; 74/526, 513

[56] References Cited

U.S. PATENT DOCUMENTS

| | | | |
|---|---|---|---|
| 3,572,304 | 3/1971 | Becker et al. | 123/364 |
| 3,704,635 | 12/1972 | Eshelman | 123/198 DB |
| 3,760,786 | 9/1973 | Marsh | 123/198 DB |
| 4,204,510 | 5/1980 | Ritter et al. | 123/374 |
| 4,512,306 | 4/1985 | Brasseur et al. | 123/367 |

*Primary Examiner*—Tony M. Argenbright
*Assistant Examiner*—Robert Mates
*Attorney, Agent, or Firm*—Sixbey, Friedman, Leedom & Ferguson

[57] ABSTRACT

A throttle stop assembly for an internal combustion engine is provided to return the throttle shaft to an idle position from a full throttle position in the event a loose throttle level mounting bolt occurs. The throttle stop assembly is designed to for the throttle shaft stop element from the full throttle position to the idle position if the throttle lever mounting bolt assembly fails, thereby preventing the engine from continuing to run in an advanced throttle condition. The stop assembly of the present invention includes a spring-biased piston contained within a threaded, hollow shaft. The spring biased piston has no effect on throttle shaft position except when the normal throttle shaft operating system fails in which case the spring biased piston will cause the throttle shaft to return to its idle position.

7 Claims, 3 Drawing Sheets

RETRACTABLE THROTTLE STOP

TECHNICAL FIELD

The present invention relates generally to throttle assemblies for internal combustion engines and particularly to a retractable throttle stop that will return the throttle shaft to the idle position should the throttle lever mounting bolt assembly experience a failure.

BACKGROUND ART

Existing engine throttling systems typically employ a throttle shaft rotatable between an adjustable idle position and an adjustable full throttle position. Such rotatable throttle shafts are normally arranged to control fuel flow through variable alignment ports. The degree of alignment of the ports is determined by the rotational position of the shaft. To permit adjustments in the idle and full throttle fuel flows, the throttle shaft is provided with a stop engaging element adapted to engage threaded adjustment screws or stops at idle and the full throttle position of the shaft, respectively. The length of these screws is adjusted as required to limit the travel of the throttle shaft stop engaging element. When the throttle shaft stop engaging element contacts the idle screw, the throttle shaft has been rotated so that only the fuel required to maintain the engine at idle speed will be directed through the throttle shaft ports. When the throttle shaft stop engaging element contacts the full throttle screw, the throttle shaft has been rotated so that a maximum amount of fuel will be directed through the throttle shaft.

Movement of the throttle shaft and throttle shaft stop engaging element between the idle and full throttle positions is usually accomplished by a throttle lever operatively connected to both an operator-actuated throttle control and one or more return springs. Advancement of the throttle control by a human operator causes the throttle lever to move the throttle shaft so that the stop engaging element travels toward the full throttle position. The full throttle position in which the throttle shaft stop contacts the full throttle screw should be reached when the throttle control is completely advanced. Release or retraction of the throttle control causes the vehicle return spring to move the throttle lever and, thus, the throttle shaft and stop element to the idle position so that the throttle shaft stop element is stopped by contact with the idle adjustment screw. Return of the throttle shaft to the preset idle position, therefore, is dependent upon the proper functioning of the throttle lever mounting bolt assembly. If the throttle lever mounting bolt assembly breaks or becomes loose, the throttle shaft may not return to the preset idle position. Should this occur, the throttle shaft will remain in an advanced position, and the throttle return spring will not be able to move the throttle shaft to the idle position since the throttle lever has lost its grip with the throttle shaft.

U.S. Pat. Nos. 3,704,635 to Eshelman and 3,760,786 to Marsh both disclose safety springs which, in the event of a failure of the return spring, return the throttle to the idle position. However, the throttle return systems described in these patents are designed to function only in the event of a return spring failure and require the throttle levers to remain intact for proper functioning. There is no provision for returning the throttle shaft to an idle position in the event of breakage or failure of the throttle lever itself.

Mechanisms which shut down engine operation by shutting off the delivery of fuel to the engine are known in the prior art. U.S. Pat. No. 4,512,306 to Brasseur et al., for example, discloses a spring loaded mechanism for returning a fuel amount control rod to a zero delivery position including a lockable stop which is locked in a maximum fuel position. When an inadmissible engine operating condition, for example an overspeed, is detected, the stop is unlocked. A shut down spring assists the stop to return the control rod to the zero delivery position, thereby shutting down the engine. There is no suggestion in this patent, however, either that this mechanism may be employed to move a throttle shaft to the idle position or that the maximum stop may include an additional mechanism to return the throttle shaft to the idle position if the throttle lever becomes inoperative. The stop disclosed in this reference is held in a locked position and, therefore, requires separate control circuits, first to detect the inadmissible engine condition and then to unlock the stop. Not only is this mechanism complex, but it requires a separate control for cutting off fuel flow.

U.S. Pat. No. 3,572,304 to Becker et al. discloses an engine shut off mechanism having a shut off lever which turns a sleeve, thereby rotating another lever into contact with a plate to thrust the plate against the opposition of a spring to move the control rod to a shut off position. However, this mechanism relies on the action of at least two levers to function and not only is there no suggestion that the mechanism would continue to function if the levers were broken or damaged, but there is also no suggestion that it may be employed to return a throttle shaft to the idle position in the event of an unacceptable engine operating condition such as a broken throttle lever.

The prior art, therefore, has failed to provide a simple, self-contained throttle return safety device which will automatically move the fuel pump throttle shaft from a full fuel to an idle position upon the failure of the throttle lever mounting bolt assembly.

SUMMARY OF THE INVENTION

It is a primary object of the present invention, therefore, to overcome the disadvantages of the prior art and to provide a retractable throttle stop that will return the throttle to the idle position should the throttle lever mounting bolt assembly become loose.

It is another object of the present invention to provide a full throttle stop for a fuel pump including integral return means for returning a throttle shaft to an idle position should the normal throttle lever mounting bolt assembly loose its grip or torque against the throttle shaft.

It is yet another object of the present invention to provide an adjustable full throttle stop normally throttle stop including a spring biased piston slidably mounted within the full throttle stop for contacting the throttle shaft stop element wherein the piston is biased in a direction to move the throttle shaft stop element to the idle position, thereby substantially reducing fuel flow to the engine, should the normal throttle lever mounting bolt assembly lose its function.

It is still another object of the present invention to provide an adjustable throttle stop assembly including a spring biased piston in association with the fuel pump of an internal combustion engine to automatically move a throttle shaft in contact therewith to an idle position in the event of breakage or failure of the throttle lever mounting bolt assembly.

It is a further object of the present invention to provide a throttle stop including an integral safety feature which is not effective as long as the throttle lever mounting bolt assembly is torqued properly, but which is effective to return the throttle shaft to a predetermined idle position in the event of throttle lever mounting bolt assembly failure.

The aforesaid object are achieved by providing in association with an internal combustion engine fuel pump a throttle stop assembly including means for automatically returning a throttle shaft to a predetermined idle position upon the occurrence of a throttle lever mounting bolt assembly malfunction. A throttle stop means is adjustably mounted in the fuel pump housing so that the full throttle position may be varied. A spring biased piston means mounted within the stop means contacts a stop element associated with the throttle shaft so that the spring is compressed and the piston means is retracted when the throttle shaft is advanced toward the full throttle fuel position. In the event that the throttle lever mounting bolt assembly fails, the spring will push the piston means outwardly of the stop means to force the throttle shaft stop element into contact with the idle stop, thereby reducing fuel flow from the full fuel amount to the preset idle level.

Other objects and advantages will be apparent from the following description, claims and drawings.

BEST MODE FOR CARRYING OUT THE INVENTION

Figure 1:
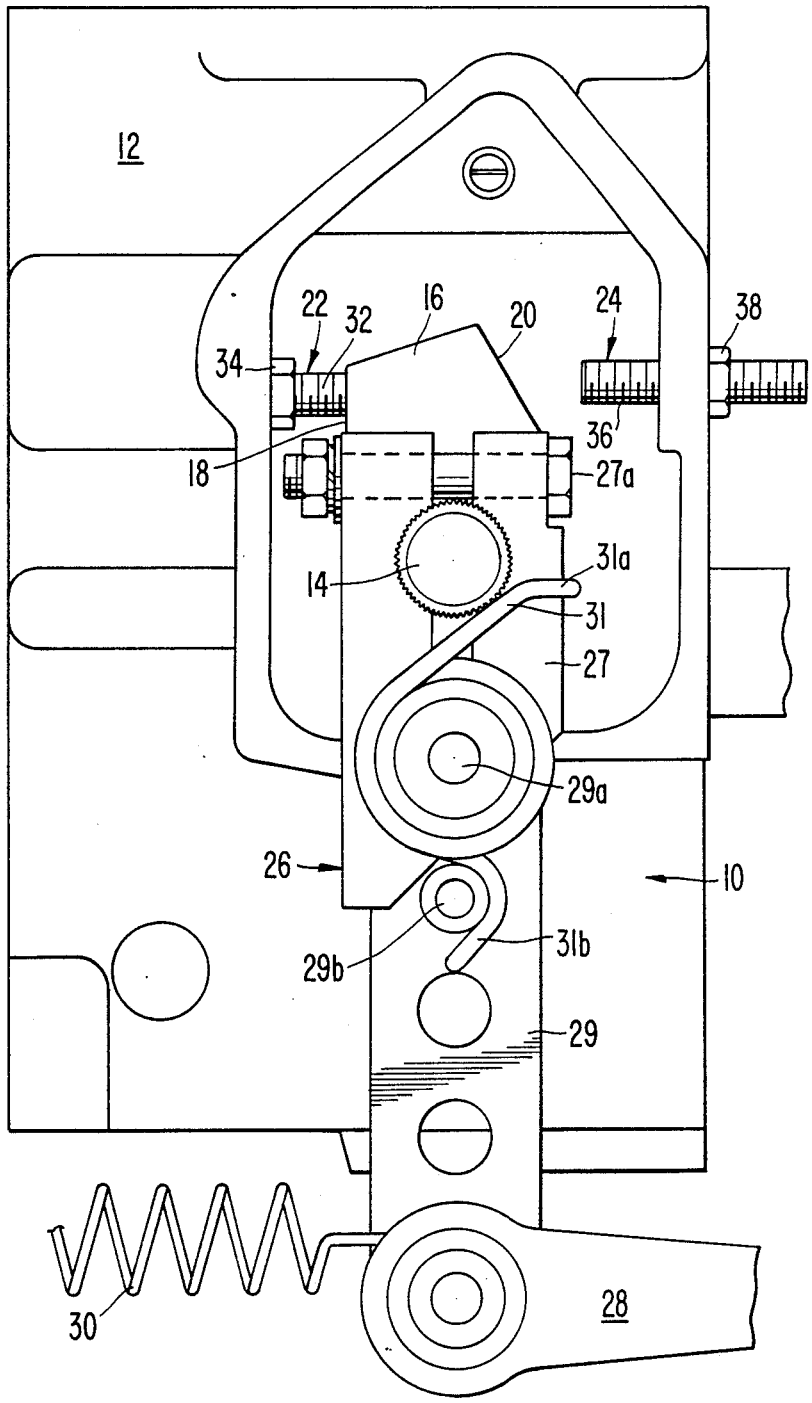
FIG. 1. (PRIOR ART)
FIG. 1 is an elevational view of a portion of a fuel pump and throttle control assembly including a prior art full throttle stop.

The throttling function of an internal combustion engine is typically controlled by the interactive functioning of an apertured throttle shaft rotatably mounted in the fuel pump to rotate between a full throttle position, wherein a maximum amount of fuel is supplied to the engine and an idle position, wherein a predetermined minimum amount of fuel is supplied to the engine. A throttle lever assembly generally provides the operative connection between the throttle shaft and an operator-actuated throttle control remote from the throttle shaft. The engine operator uses the throttle control initially to advance the throttle lever assembly and, hence, the throttle shaft from the idle position toward the full throttle position. When it is desired to return the engine throttling to idle, the operator simply retracts or releases the throttle control, which allows one or more return springs acting on the throttle lever assembly to return the throttle shaft to its preset idle position. FIG. 1 illustrates a prior art system employing such a throttle assembly.

Referring to FIG. 1, the throttle assembly 10 is mounted on a fuel pump 12 to rotate a throttle shaft 14 between the full throttle position shown in FIG. 1 and the idle position, which is not shown. Secured to the throttle shaft 14 is a throttle shaft stop element 16 including sides 18 and 20 which contact, respectively, the full throttle and idle stops 22 and 24 when the throttle shaft is in its respective full throttle and idle positions. Side 18 of throttle shaft stop member 16 is seen contacting full throttle stop 22 in FIG. 1. A throttle lever assembly 26 is mounted on the throttle shaft 14 to move the shaft between the full throttle and idle positions in response to movement of the throttle control (not shown). Throttle lever assembly 26 includes a throttle lever 27 connected by means of a throttle lever mounting bolt assembly **27*a* to shaft 14 and a link lever 29 pivotally connected by a pivot pin 29*a* or to throttle lever 27. A return spring 30** is arranged to bias the throttle lever assembly in the idle direction.

A connector linkage 28 provides the operative connection between the throttle control (not shown) and the throttle lever assembly 26. As described in more detail in the commonly assigned co-pending application entitled Dual Acting - Double Breakover Throttle Lever filed in the name of Tibor J. Villanyi and Kevin W. Westerson, incorporated hereby by reference, the link lever 29 is biased by coil spring 31 into a normal operative position in which it is axially aligned with throttle lever 27 as illustrated in FIG. 1. One end **31*a* of spring 31 contacts throttle lever 27 and the other end 31*b* contacts a pin 29*b* attached to link lever 29. Should the throttle control continue to apply advancing force to the lever assembly 26 after stop element 16 engages full throttle stop 22, lever assembly 26 will operate in a "breakover" mode in which link lever 29 will rotate about is pivot pin 29*a*, thereby limiting the maximum force which may be applied to the throttle shaft by throttle lever 27** in the throttle advancing direction.

Retraction of the throttle control releases the force that caused the spring 31 to flex, and, as a result, the lever assembly 26 can assume its normally aligned configuration. Continued retraction or release of the throttle control will allow return cause spring 30 to move the throttle lever assembly 26 and the throttle shaft 14 in a direction to reduce fuel flow and eventually cause side 20 of the throttle shaft stop element 16 to contact the idle stop 24, thereby stopping the throttle shaft 14 in its idle position as defined by idle stop 24.

The prior art full throttle and idle stops shown in FIG. 1 are formed from threaded rods, the positions of which can be easily changed to limit the travel of the stop element 16. Full throttle stop 22 includes a threaded rod 32 which threadedly received in the fuel pump housing and is locked in place by a threaded nut 34. The distance that rod 32 extends beyond nut 34 can be adjusted as required to insure that when side 18 of the stop element 16 makes contact with the threaded rod, the throttle shaft 14 occupies the desired full throttle position.

Likewise, the idle stop 24 includes a threaded rod 36 which extends through the fuel pump housing as shown in FIG. 1 and is locked in place by a threaded nut 38. The distance that the threaded rod 36 extends through the fuel pump housing toward the throttle shaft stop element 16 determines the rotational position of of the throttle shaft in the idle position. The length of rod 36, therefore, must be carefully adjusted to insure that when the force of return spring 30 causes side 20 of stop element 16 to contact the rod 36, the throttle shaft will be in the desired idle position.

Figure 2:
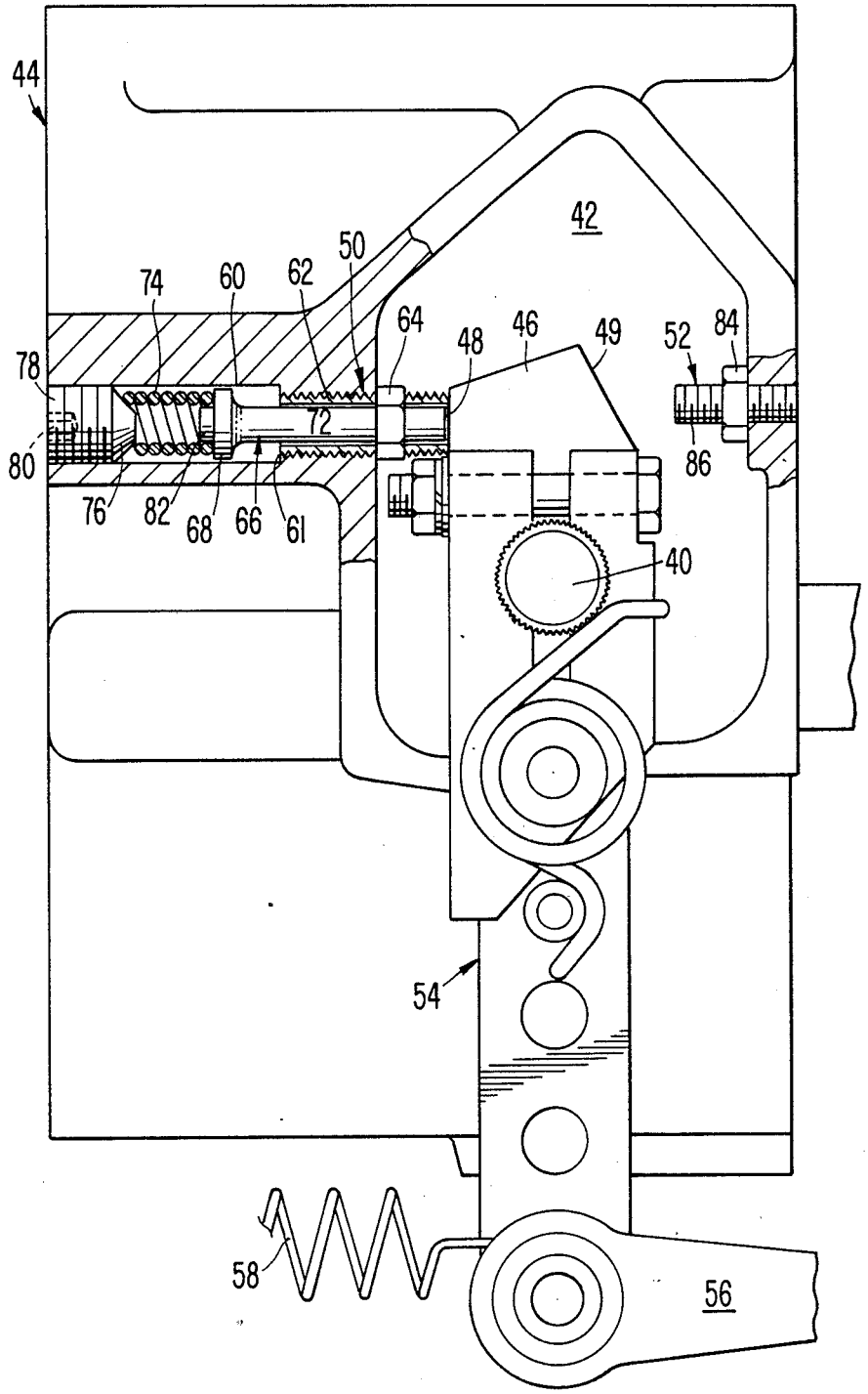
FIG. 2 is an elevational view of a portion of a partially cut away fuel pump showing the full throttle stop assembly of the present invention including a spring biased piston in its retracted condition.
Figure 3:
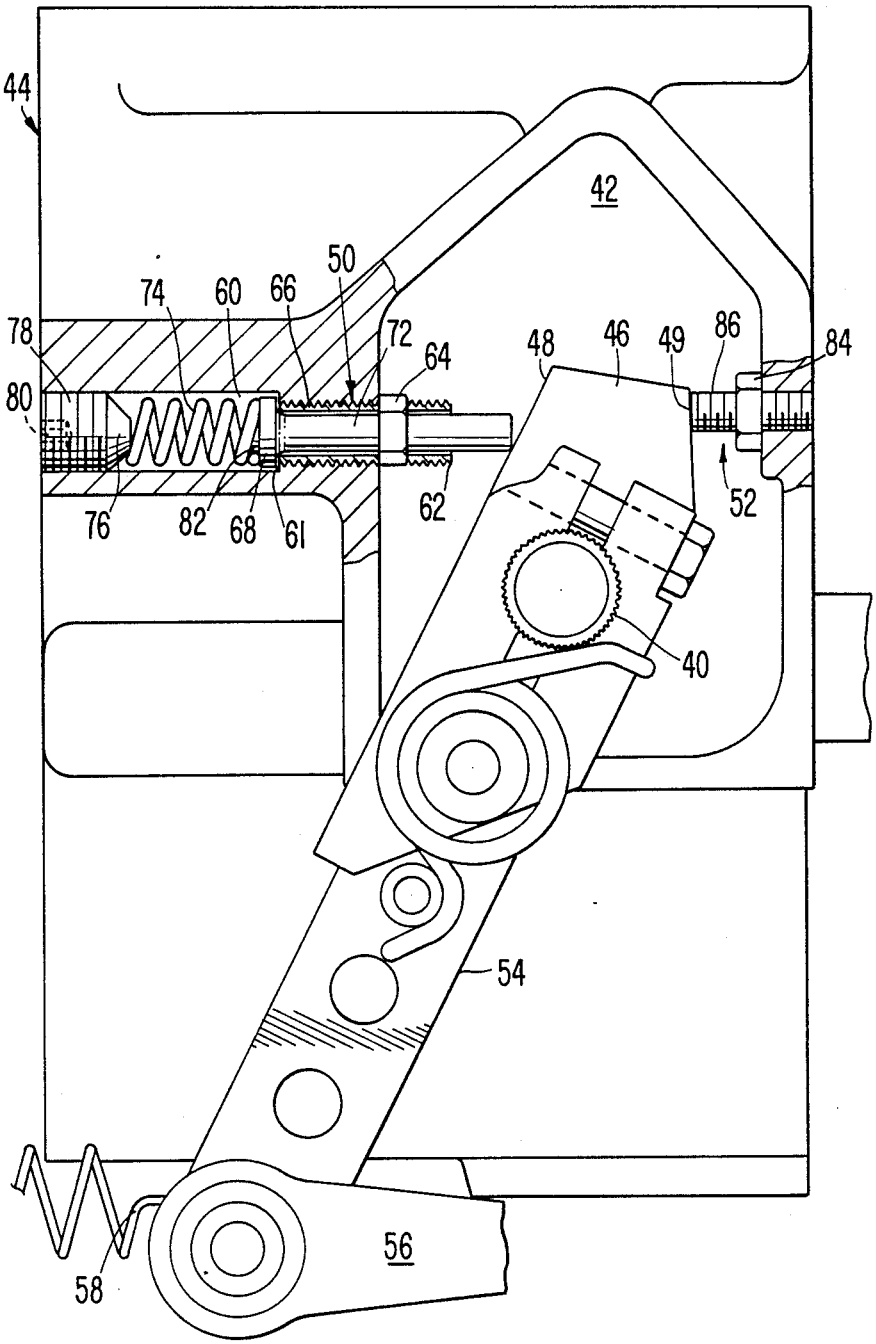
FIG. 3 is an elevational view of a portion of a partially cut away fuel pump showing the full throttle stop of the present invention including a spring biased extended condition.

The aforementioned arrangement functions adequately to insure that the throttle shaft will not remain in the full throttle position, but will return to the idle position as long as the throttle lever mounting bolt assembly 27a remains tightly secured. However, if the throttle lever mounting bolt assembly 27a breaks or becomes loose, the throttle shaft 14 could remain in an advanced position because there is no mechanism for returning it toward the idle position. Consequently, the engine will continue to operate in an advanced throttle condition. This is clearly an undesirable condition and one which the present invention is designed to avoid. FIGS. 2 and 3 illustrate the manner in which the present invention accomplishes this objective.

In FIG. 2, a throttle shaft 40 is mounted within the housing 42 of the fuel pump 44 for rotation between an idle position and a full throttle position. In the idle position, a predetermined minimum amount of fuel is permitted to flow through the throttle shaft. In the full throttle position, a maximum amount of fuel flows through the throttle shaft. The throttle shaft is shown in the full throttle position in FIG. 2. In this position, one side 48 of throttle shaft stop element 46 contacts a full throttle stop assembly 50. Side 49 of the stop element 46 is arranged to contact an idle stop 52 when the throttle shaft 40 is in its idle position, as will be described in detail in connection with FIG. 3. A throttle lever assembly 54 of the type illustrated in FIG. 1 operatively connects the throttle shaft 40 to the engine throttle control (not shown) through a connector linkage 56. A return spring 58, which biases the throttle lever assembly and, hence, the throttle shaft toward the idle position returns the throttle lever assembly and the throttle shaft to the idle position when the force exerted on the throttle lever assembly by the throttle control through the connector linkage is released.

As previously mentioned, if the throttle lever mounting bolt assembly breaks or becomes loose the throttle shaft will not be biased to return to the idle position, and throttle control may be lost. To safeguard against this possibility, the present invention provides a throttle stop assembly 50 including structure specifically designed to insure that the throttle shaft will not remain in the advanced throttle position if the throttle lever mounting bolt assembly 27a fails. A portion of the fuel pump housing 42 has been cut away to illustrate in detail stop assembly 50 of the present invention.

The stop assembly 50 is fitted within a stepped bore 60 which includes shoulders 61 in the fuel pump housing and includes a hollow threaded shaft 62 held in place in the fuel pump housing by threaded adjustment nut 64. However, the threaded shaft 62 is hollow and contains therewithin an axially movable piston 66 which includes a base 68, and a reduced diameter shaft 72 extending through the hollow threaded shaft 62. A coiled compression spring 74 located within the fuel pump housing bore 60 contacts the base 68 of the piston 66 and biases the piston toward the throttle shaft stop element 46 which is affixed to the throttle shaft. A spring anchor 76 retains one end of spring 74 in place within the bore 60. The other end of spring 74 is held in place by extension 82 of piston base 68.

A removable access cap 78, which seals the bore 60 in the fuel pump housing, is preferably provided to facilitate installation of the present stop assembly. An Allen wrench socket 80 is provided in cap 78 for ease of removal. The access cap seals the bore 60 and assures that the spring 74 and piston 66 will be protected from engine dirt and grime, thereby extending the useful life of these structures.

The idle stop 52 preferred for use with the present invention differs from the prior art arrangement shown in FIG. 1 in that the adjustment nut 84 holding the threaded rod 86 has been moved from the outer surface of the fuel pump housing to the fuel pump housing recess portion adjacent to the throttle shaft. The idle stop threaded shaft 86 may then be made shorter, since it is no longer required to protrude through the fuel pump housing far enough to receive an adjustment nut.

FIG. 3 illustrates how the components of the full throttle stop assembly 50 function synergistically to insure the return of the throttle shaft to the idle position if the throttle lever mounting bolt assembly malfunctions. The present invention, therefore, insures that the engine will not be stuck in an advanced full throttle condition upon the occurrence of an unacceptable engine operating condition such as the breakage or looseness of a throttle lever mounting bolt assembly.

The operation of the present invention has been described primarily in mechanical terms. However, electric or electronic sensors and/or control elements and circuits could be provided in connection with the present invention. Such control elements, for example, could limit the action of the spring and piston to forcibly move the throttle shaft stop element to idle only upon the sensing of an unacceptable engine operating condition as previously discussed and are intended to be encompassed by the present invention.

INDUSTRIAL APPLICABILITY

The present invention will find its primary applicability in connection with the throttling structures of an internal combustion engine wherein it is desired to provide a safety return that will insure return of engine throttling to an idle condition in the event of an occurrence of a malfunction in the throttle lever mounting bolt assembly.

We claim:

1. A throttle stop assembly for use on an internal combustion engine fuel pump having a throttle shaft and throttle shaft stop element integrally attached to the throttle shaft for rotation between an idle position in which minimal fuel is supplied to the engine and a full throttle position in which maximum fuel is supplied to the engine and having a throttle lever assembly attached to the throttle shaft by a throttle lever mounting bolt assembly adapted to move the throttle shaft between its idle and full throttle positions in response to a throttle control, said throttle stop assembly comprising a full throttle stop means positioned to engage the throttle stop means positioned to engage the throttle stop element to define the full throttle position of said throttle shaft stop element, said full throttle stop means including piston means engaging said throttle shaft stop element to bias the throttle shaft toward its idle position but being ineffective to move said throttle shaft to its idle position except when the throttle lever mounting bolt assembly has malfunctioned.

2. The throttle stop assembly described in claim 1, wherein said piston means includes a piston mounted for sliding movement within said full throttle stop means.

3. The throttle stop assembly described in claim 2, wherein said piston means includes spring means for biasing said piston toward said throttle shaft stop element, said spring means including a compression spring.

4. The throttle stop assembly described in claim 3, wherein said full throttle stop means further includes a threaded hollow shaft rotatably movable to adjust said full throttle position of the throttle shaft.

5. The throttle stop assemble described in claim 4, wherein said piston is received within said threaded hollow shaft and is axially movable therein.

6. The throttle stop assembly described in claim 5, wherein one end of said piston protrudes beyond said threaded hollow shaft whenever the throttle shaft is retracted from its full throttle position.

7. A full throttle stop assembly for mounting in association with a fuel pump having a rotatable throttle shaft and a throttle lever assembly in combination with a throttle lever mounting bolt assembly for moving the throttle shaft between full throttle and idle position, said full throttle stop assembly including a full throttle stop means for defining the full throttle position of the throttle shaft and further including a spring loaded piston means for moving the throttle shaft from the full throttle position to the idle position only upon a malfunction of the throttle lever mounting bolt assembly.

* * * * *